US006578661B2

(12) United States Patent
Ohashi et al.

(10) Patent No.: US 6,578,661 B2
(45) Date of Patent: Jun. 17, 2003

(54) SPEAKER APPARATUS

(75) Inventors: Yoshio Ohashi, Kanagawa (JP); Masaru Uryu, Chiba (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 09/872,745

(22) Filed: Jun. 1, 2001

(65) Prior Publication Data

US 2002/0005317 A1 Jan. 17, 2002

(30) Foreign Application Priority Data

Jun. 5, 2000 (JP) ..... 2000-167902

(51) Int. Cl.[7] ..... G10K 13/00

(52) U.S. Cl. ..... 181/161; 181/157; 181/163; 181/164; 181/165; 181/171

(58) Field of Search ..... 181/161, 157, 181/163–165, 171

(56) References Cited

U.S. PATENT DOCUMENTS 4,379,951 A * 4/1983 Gabr ..... 381/431
5,033,093 A * 7/1991 Tardo ..... 381/177
5,283,397 A * 2/1994 Pavlovic ..... 181/163

FOREIGN PATENT DOCUMENTS

JP 352051929 * 4/1977

* cited by examiner

*Primary Examiner*—Shih-yung Hsieh
(74) *Attorney, Agent, or Firm*—Jay H. Maioli

(57) ABSTRACT

A speaker apparatus which can remove undesirable vibrations and can produce sounds of excellent quality of acoustic signals having high audio frequencies is presented by increasing a strength of a flat joint portion and by properly setting a mass ratio between a central dome-like diaphragm and an edge-like diaphragm of a speaker diaphragm. This speaker apparatus includes a diaphragm portion in which a mass ratio of the edge-like diaphragm relative to the dome-like diaphragm falls within a predetermined range near 1 and a fixed portion at which a bobbin of a voice coil or an end face of a conductive one turn ring is bonded to and fixed to a flat portion for joining the dome-like diaphragm and the edge-like diaphragm so that mechanical strength of a joint flat portion of the diaphragms can be increased.

8 Claims, 8 Drawing Sheets

SPEAKER APPARATUS

BACKGROUND OF THE INVENTION

1. Field of the Invention

The present invention relates to a speaker apparatus for use with various acoustic devices, visual devices and the like, for example.

2. Description of the Related Art

FIG. 1 shows an example of a speaker apparatus according to the related art. As shown in FIG. 1, this related-art speaker apparatus includes a dome-like acoustic diaphragm 121 at its center. A diaphragm having a curvature R in cross-section or a straight-line-like edge is formed from the side edge of this acoustic diaphragm 121.

A plate 126 is provided on a magnet 124 and a voice coil 123 is formed so as to have a gap 127 between it and a pole piece 125. Then, a bobbin 122 of the voice coil 123 is fixed to the acoustic diaphragm 121.

Accordingly, when a signal is inputted to a signal input line 128, the voice coil 123 is vibrated in the upper and lower direction by electromagnetic force applied to a current flowing through the voice coil 123 in a magnetic field generated by the magnet 124. Concurrently therewith, the acoustic diaphragm 121 is actuated to produce audio-frequency vibrations. FIG. 1 shows a conductive type speaker as an example of the related-art speaker apparatus.

In the case of the conductive type speaker, for example, in order to drive this diaphragm, as shown in FIG. 2 which illustrates a method of bonding a conductive type speaker diaphragm and a voice coil bobbin, a voice coil 138 is wound around a cylindrical bobbin 137 having a uniform diameter, and a front end of the bobbin 137 is bonded to a dome-like inner peripheral edge portion 133 of a dome-like diaphragm 132 of a diaphragm 131 by an adhesive agent 139.

This diaphragm 131 is fixed to a suitable means such as a frame, not shown, from a side edge of the dome-like diaphragm 132 through a joint flat portion 134 by a diaphragm side edge 136 of an edge-like diaphragm 135 having a curved-line-like cross-section or a straight-line-like cross-section.

On the other hand, in the case of a conductive type electromagnetic induction speaker, as shown in FIG. 3 which illustrates a method of bonding a conductive type electromagnetic induction speaker diaphragm and a voice coil bobbin, a conductive one turn ring 148 is fixed around a cylindrical bobbin 147 having a uniform diameter, and a front end of the bobbin 147 is bonded to a dome-like diaphragm inner peripheral edge portion 143 of a dome-like diaphragm 142 of a diaphragm 141 by an adhesive agent 149.

Alternatively, as shown in FIG. 4 which illustrates a method of bonding a conductive type electromagnetic induction speaker diaphragm and a conductive one turn ring, a front end of a cylindrical conductive one turn ring 157 having a uniform diameter is bonded to a dome-like diaphragm inner peripheral edge portion 153 of a dome-like diaphragm 152 of a diaphragm 151 by an adhesive agent 158.

As shown in FIG. 1, the conductive type speaker and the conductive type electromagnetic induction speaker are each comprised of a magnetic circuit including a permanent magnet (magnet 124) and the magnetic gap 127. The voice coil 138 shown in FIG. 2 or the conductive one turn rings 148, 157 shown in FIGS. 3 and 4 are held within this magnetic gap 127.

Accordingly, as shown in FIG. 2, when a signal current flows through the voice coil 138, the diaphragm 131 is vibrated to output acoustic energies.

Alternatively, as shown in FIGS. 3 and 4, when an induced current of a signal current flows through the conductive one turn rings 148, 157, the diaphragms 141, 151 are vibrated to output acoustic energies.

However, in the above related-art speaker apparatus, the diaphragms 131, 141, 151 including the dome-like diaphragms 132, 142, 152 and the edge-like diaphragms 135, 145, 155 are each manufactured by integrally molding a thin metal sheet such as an aluminum sheet and a titanium sheet or a polymer sheet, and the like. As a result, since the metal sheet or the polymer sheet and the like is pulled in both directions, it is unavoidable that the joint flat portions 134, 144, 154 for joining the dome-like diaphragms 132, 142, 152 and the edge-like diaphragms 135, 145, 155 are reduced in thickness.

When the voice bobbins 137, 147 or the conductive one turn ring 157 are bonded to the diaphragms 131, 141, 151 by the above related-art bonding methods and an acoustic signal is inputted to the speaker apparatus, at a certain frequency, the dome portions and the edge portions are vibrated to produce audio-frequency vibrations whose phases are displaced by 180 degrees across the joint flat portions 134, 144, 154 having a small mechanical strength. At this frequency, the acoustic signal generated from the dome portion and the acoustic signal generated from the edge portion are canceled with each other out so that a dip of a sound pressure occurs. In particular, when this dip of the sound pressure lies in an audible band, a quality of an acoustic signal is degraded.

SUMMARY OF THE INVENTION

In view of the aforesaid aspect, it is an object of the present invention to provide a speaker apparatus capable of eliminating vibrations of the dome portion and the edge portion with a phase difference of 180 degrees and which is capable of reproducing sounds of excellent quality of acoustic signals having high audio frequencies by increasing a strength of a flat joint portion and by properly setting a mass ratio between a dome-like diaphragm and an edge-like diaphragm of a speaker diaphragm.

According to an aspect of the present invention, there is provided a conductive type speaker apparatus in which a speaker diaphragm formed by joining a dome-like diaphragm and an edge-like diaphragm is actuated to vibrate by using a voice coil. This speaker apparatus is comprised of a diaphragm portion in which a mass ratio of the edge-like diaphragm relative to the dome-like diaphragm falls within a predetermined range near 1 and a fixed portion at which an end face of the voice coil bobbin is bonded to and fixed to a flat portion for joining the dome-like diaphragm and the edge-like diaphragm.

According to another aspect of the present invention, there is provided a conductive electromagnetic induction speaker in which a speaker diaphragm formed by joining a dome-like diaphragm and an edge-like diaphragm is vibrated by electromagnetic induction generated from a conductive one turn ring. This conductive electromagnetic induction speaker is comprised of a diaphragm portion in which a mass ratio of the edge-like diaphragm relative to the dome-like diaphragm falls within a predetermined range near 1 and a fixed portion at which an end face of the conductive one turn ring is bonded to and fixed to a flat portion for joining the dome-like diaphragm and the edge-like diaphragm.

In the speaker apparatus according to the present invention, a diaphragm of a conductive type speaker and a conductive type electromagnetic induction speaker is molded in such a manner that a mass ratio between the central dome-like diaphragm and the edge-like diaphragm falls within a range near 1, e.g., a mass ratio falls within a range of from 0.5 to 1.5. Further, since the end face of the voice coil bobbin or the end face of the conductive one turn ring is bonded to the flat portion which joints the central dome-like diaphragm and the edge-like diaphragm, a mechanical strength of the flat portion can be increased.

Therefore, according to the present invention, there can be obtained the following actions.

According to the speaker apparatus including the diaphragm portion comprised of the dome-like diaphragm and the edge-like diaphragm and the fixed portion bonded to and fixed to the coil bobbin or the conductive one turn ring and the flat portion, by increasing strength of the joint flat portions joining the dome-like diaphragm and the edge-like diaphragm the mechanical strength of which has been weak, vibrations of the dome-like diaphragm and the edge-like diaphragm with a phase difference of 180 degrees can be removed and sounds of high audio frequencies, e.g., sounds of high audio frequencies up to 50 kHz can be reproduced.

DESCRIPTION OF THE PREFERRED EMBODIMENT

A speaker apparatus according to an embodiment of the present invention will now be described below with reference to the drawings.

A speaker apparatus according to the embodiment of the present invention is molded in such a manner that a mass ratio between a dome-like diaphragm and an edge-like diaphragm may fall within a range near 1, e.g., a mass ratio may fall within a range of from 0.5 to 1.5. Further, an end face of a voice coil bobbin or an end face of a conductive one turn ring is bonded to a flat portion which joints a central dome-like diaphragm and an edge-like diaphragm so that the speaker apparatus according to this embodiment becomes able to reproduce sounds of high audio frequencies up to 50 kHz.

Figure 1:
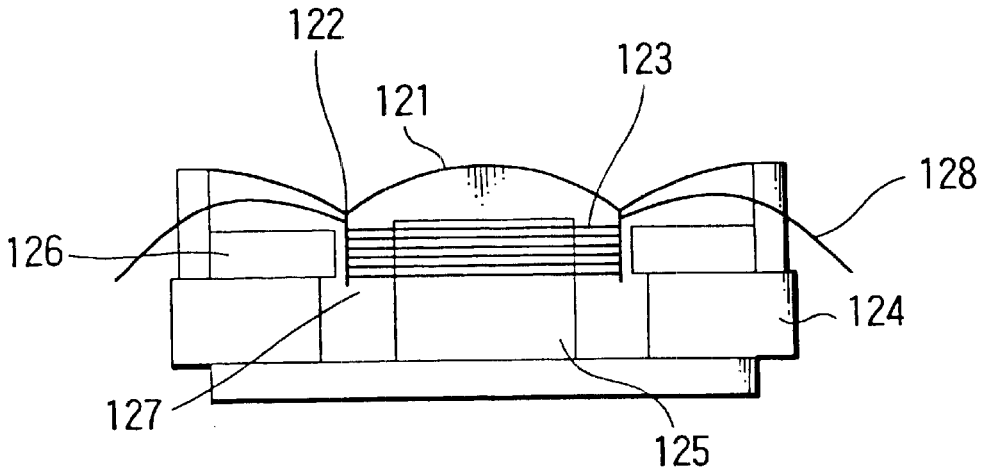
FIG. 1 (PRIOR ART)
FIG. 1 is a schematic diagram showing a structure of a speaker apparatus according to the related art.
Figure 2:
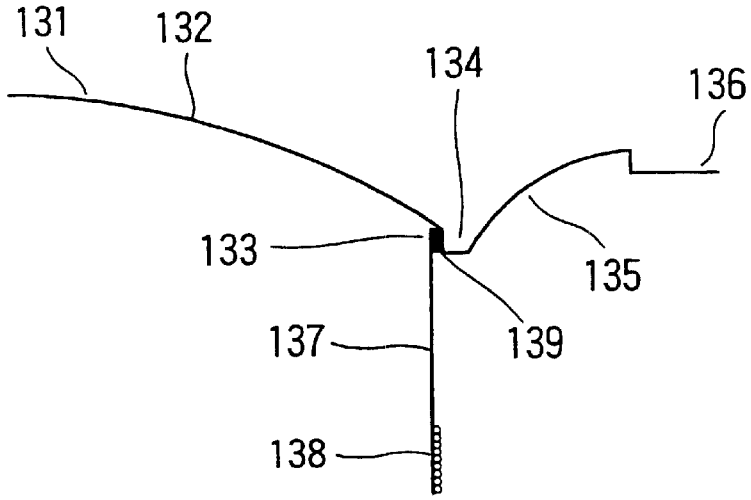
FIG. 2 (PRIOR ART)
FIG. 2 is a schematic diagram to which reference will be made in explaining a method of bonding a conductive type speaker diaphragm and a voice bobbin according to the related art.
Figure 3:
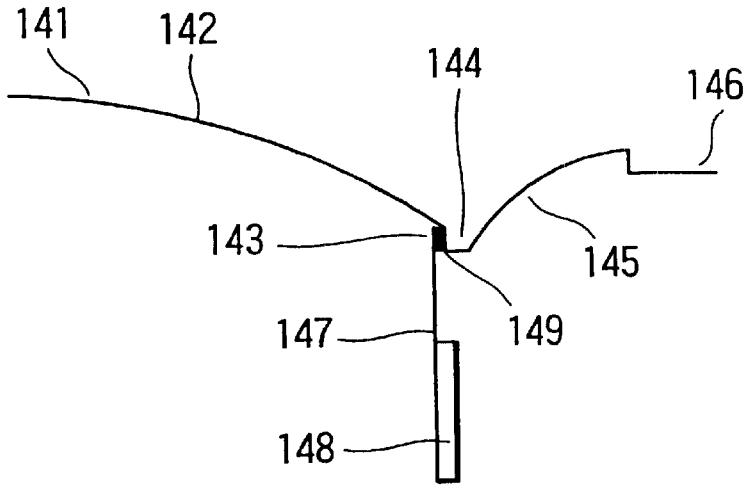
FIG. 3 (PRIOR ART)
FIG. 3 is a schematic diagram to which reference will be made in explaining a method of bonding a conductive type electromagnetic induction speaker diaphragm and a bobbin according to the related art.
Figure 4:
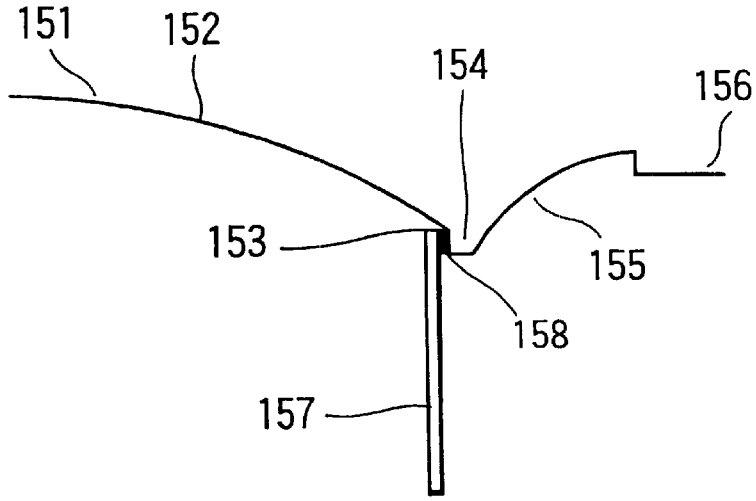
FIG. 4 (PRIOR ART)
FIG. 4 is a schematic diagram to which reference will be made in explaining a method of bonding a conductive type electromagnetic induction speaker diaphragm and a conductive one turn ring according to the related art.
Figure 5:
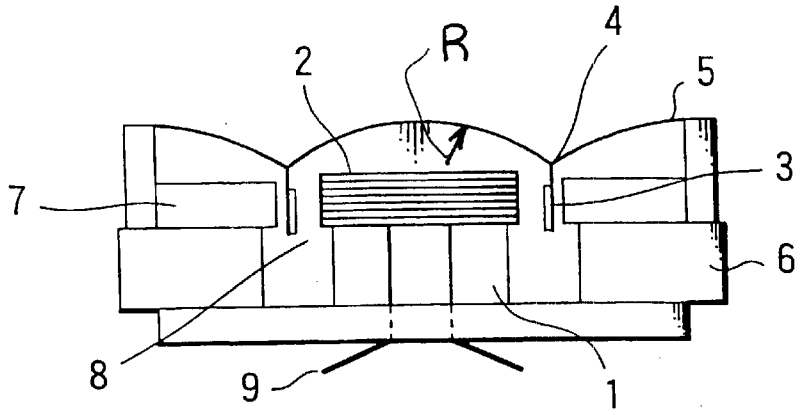
FIG. 5 is a schematic diagram showing a structure of a speaker apparatus according to an embodiment of the present invention.

As shown in FIG. 5, the speaker apparatus according to this embodiment includes a dome-like acoustic diaphragm 5 at its center. A diaphragm is formed from the side edge of this acoustic diaphragm 5 so as to have a curvature R in cross-section or a straight-line-like edge.

Then, a plate 7 is provided on a magnet 6 and a conductive one turn ring 3 is formed so as to have a gap 8 between it and an excitation primary coil 2 wound around a pole piece 1. A bobbin 4 of the conductive one turn ring 3 is fixed to the acoustic diaphragm 5. The arrangement of the acoustic diaphragm 5 and an arrangement of a fixed portion by which the acoustic diaphragm 5 and the bobbin 4 are fixed to each other will be described in detail later on.

When a signal is inputted to a signal input line 9 connected to the excitation primary coil 2, a current flowing through the excitation primary coil 2 changes so that a magnetic field generated by the magnet 6 and the excitation primary coil 2 changes to allow an induced current to flow through the conductive one turn ring 3. As a result, since the conductive one turn ring 3 is actuated in the upper and lower direction by electromagnetic force, the acoustic diaphragm 5 is actuated to vibrate concurrently therewith. FIG. 5 shows the conductive type electromagnetic induction speaker by way of example.

Figure 6:
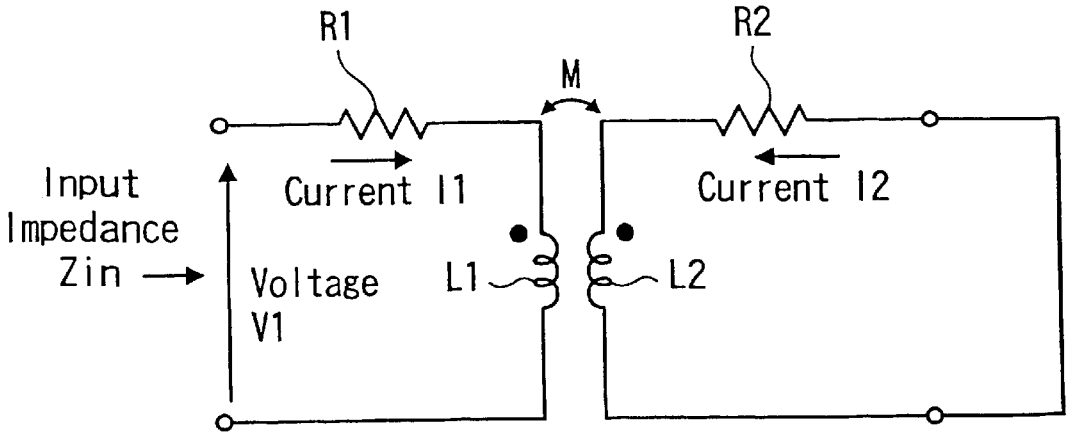
FIG. 6 is a schematic diagram showing an equivalent circuit of an induction section of an electromagnetic induction speaker.

FIG. 6 shows an example of an equivalent circuit of an induction section of the above electromagnetic induction speaker. When a voltage V1 equivalent to an input signal is applied to a resistor R1 and a coil L1 at the primary side of an input impedance Z in equivalent to the excitation primary coil 2 shown in FIG. 5 to allow a current I1 to flow through the resistor R1 and the coil L1, a current I2 equivalent to an output signal generated by induction of a mutual inductance M flows through a resistor R2 and a coil L2 at the secondary side equivalent to the conductive one turn ring 3 shown in FIG. 5.

Figure 7:
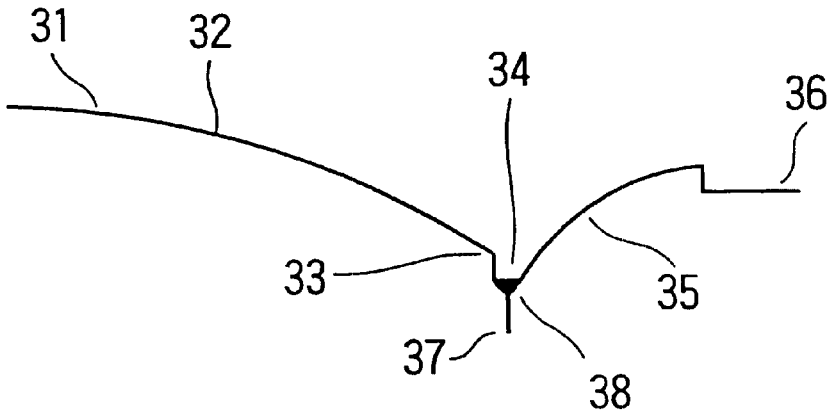
FIG. 7 is a schematic diagram to which reference will be made in explaining a method of bonding a conductive type speaker diaphragm, an electromagnetic induction speaker diaphragm and a bobbin according to an embodiment of the present invention.

In order to drive the diaphragm shown in FIG. 5, in the case of the conductive speaker, for example, as shown in FIG. 7 which illustrates a method of bonding a conductive speaker diaphragm and a voice coil bobbin, a voice coil, not shown, is wound around a cylindrical bobbin 37 having a uniform diameter or a conductive one turn ring is fixed around the cylindrical bobbin 37, and a front end of the bobbin 37 is bonded to a joint flat portion 34 between an edge diaphragm 34 and a dome-like diaphragm 32 by an adhesive agent 38.

This diaphragm 35 is fixed to a suitable means such as a frame from the side edge of the dome-like diaphragm 32 through the joint flat portion 34 by a diaphragm side edge 36 of an edge-like diaphragm 35 having a curved-line cross-section or a straight-line-like cross-section.

As shown in FIG. 5, the conductive type speaker and the conductive type electromagnetic induction speaker are each comprised of a magnetic circuit including a permanent magnet (magnet 6) and a magnetic gap 8, and the conductive one turn ring 3 is held within this magnetic gap 8.

Accordingly, as shown in FIG. 5, when a signal is inducted in the conductive one turn ring 3 by supplying a signal current to the excitation primary coil 2, the acoustic diaphragm 5 is actuated to vibrate to output acoustic energies.

According to the related art, the bobbin including the voice coil bobbin and the conductive one turn ring are made of a considerably thin sheet in order to reduce a weight of a diaphragm system containing the bobbin and the diaphragm. For this reason, the end face of the bobbin has a width narrower than that of the joint flat portion which joints the dome-like diaphragm and the edge-like diaphragm.

According to this embodiment, as shown in FIG. 7, the adhesive agent 38 is coated on the joint flat portion 34 in accordance with the width of the joint flat portion 34 of the diaphragm 31 and thereby the bobbin 37 is fixed to the joint flat portion 34, thereby increasing the mechanical strength of the joint flat portion 34.

Figure 8:
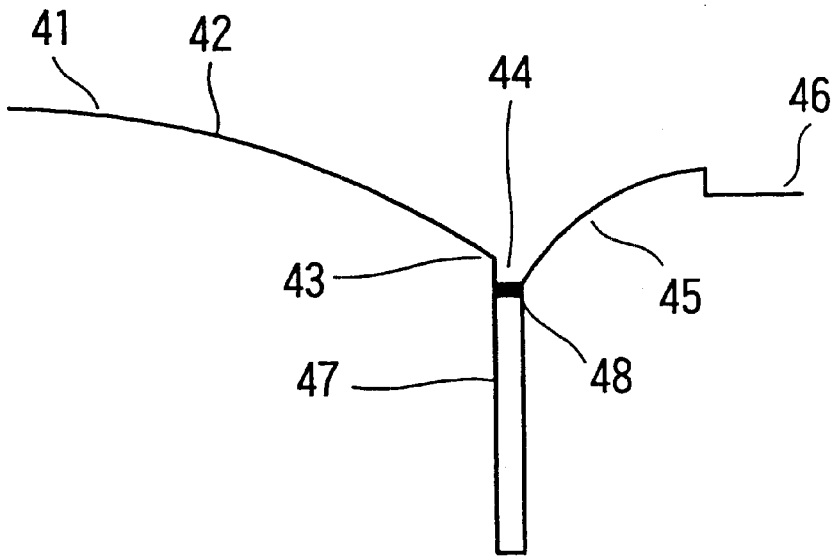
FIG. 8 is a schematic diagram to which reference will be made in explaining a method of bonding a conductive type electromagnetic induction speaker diaphragm and a conductive one turn ring according to an embodiment of the present invention.

On the other hand, FIG. 8 shows a case in which a conductive one turn ring 47 is bonded to a diaphragm 41. The conductive one turn ring 47 has the end face the width of which is larger than that of the bobbin in order to reduce its own electric resistance. In this case, when a width of a joint flat portion 44 which joints a dome-like diaphragm 42 and an edge-like diaphragm 45 is selected to be equal to that of the end face of the conductive one turn ring 47, the mechanical strength of this portion can be increased more.

Figure 9:
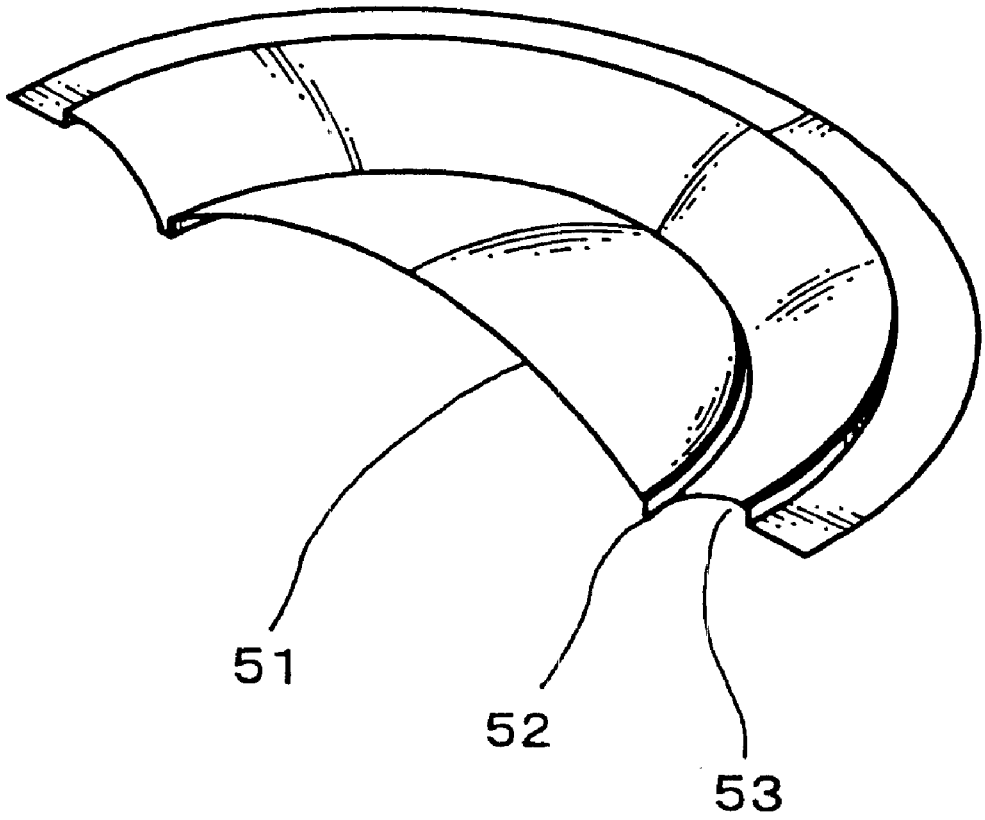
FIG. 9 is a perspective view showing a cross-section of a speaker diaphragm according to an embodiment of the present invention.

FIG. 9 is a perspective view showing the cross-section of the diaphragm of the speaker according to the embodiment of the present invention. A mass ratio between a dome-like diaphragm 51 and an edge-like diaphragm 53 falls within a range of from 0.5 to 1.5, and the respective diaphragms 51 and 53 are coupled together by a flat joint flat portion 52 The range of this mass ratio is determined based on experimental values of FIGS. 10 to 15 which will follow.

Figure 10:
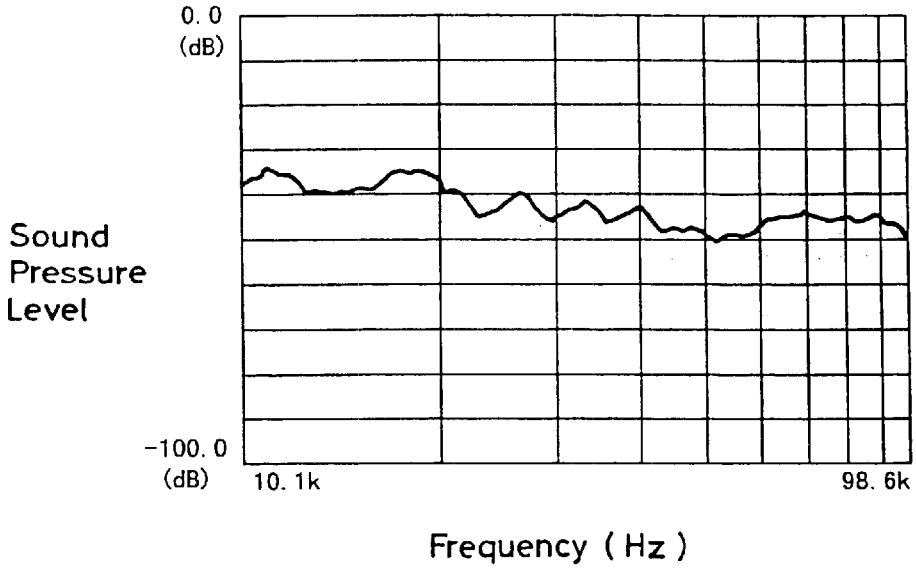
FIG. 10 is a graph showing sound pressure versus frequency characteristics obtained from a speaker having a structure in which a voice coil bobbin is bonded to a joint flat portion between a central dome-like diaphragm and an edge-like diaphragm when a mass ratio of the central dome-like diaphragm and the edge-like diaphragm is 1.004.

FIG. 10 is a graph showing sound pressure versus frequency characteristics obtained from a speaker having an arrangement in which a mass ratio between a central dome-like diaphragm and an edge-like diaphragm is 1.004 and a voice coil bobbin is bonded to a joint flat portion by which the central dome-like diaphragm and the edge-like diaphragm are jointed together. A study of FIG. 10 reveals that audio signal having audio frequencies up to 100 kHz (−10 dB) can be reproduced. At that time, since a balanced dome in which a mass ratio between a central dome-like diaphragm and an edge-like diaphragm is 1:1 can be formed, vibrations with highest efficiency can be converted into acoustic output, thereby making it possible to eliminate a dip of sound pressure.

Figure 11:
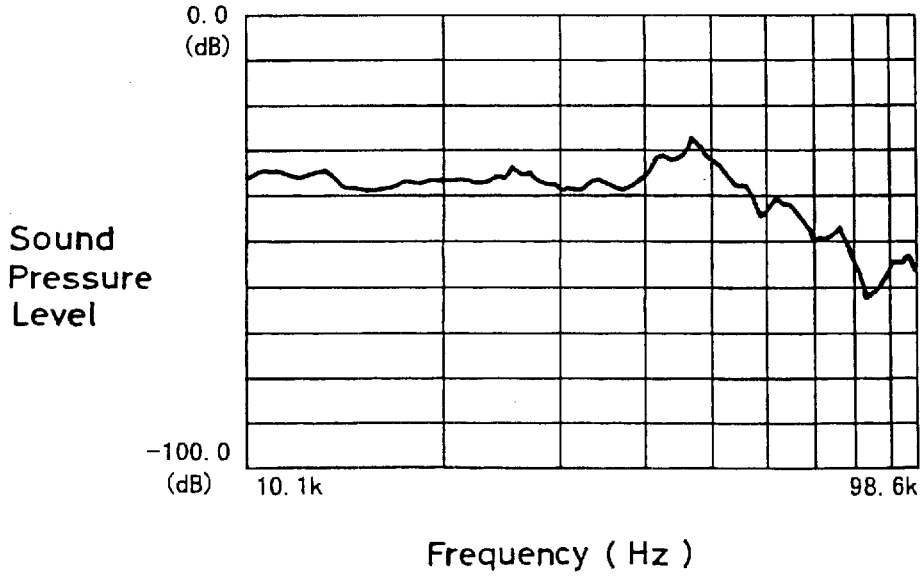
FIG. 11 is a graph showing sound pressure versus frequency characteristics obtained from a speaker having a structure in which a voice coil bobbin is bonded to a joint flat portion between a central dome-like diaphragm and an edge-like diaphragm when a mass ratio of the central dome-like diaphragm and the edge-like diaphragm is 0.5.

FIG. 11 is a graph showing sound pressure versus frequency characteristics obtained from a speaker having an arrangement in which a mass ratio between a central dome-like diaphragm and an edge-like diaphragm is 0.5 and a voice coil bobbin is bonded to a joint flat portion by which the central dome-like diaphragm and the edge-like diaphragm are jointed together. A study of FIG. 11 reveals that audio signal having audio frequencies up to 50 kHz (−10 dB) can be reproduced. At that time, since a balanced dome in which a mass ratio between a central dome-like diaphragm and an edge-like diaphragm is 1:0.5 can be formed, vibrations with highest efficiency can be converted into acoustic output, thereby making it possible to eliminate a dip of sound pressure.

Figure 12:
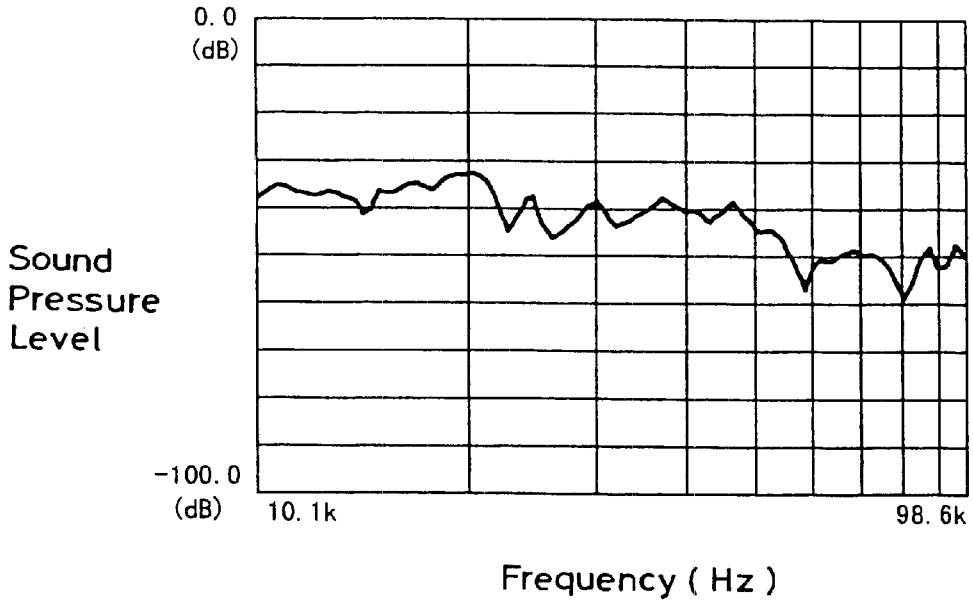
FIG. 12 is a graph showing sound pressure versus frequency characteristics obtained from a speaker having a structure in which a voice coil bobbin is bonded to a joint flat portion between a central dome-like diaphragm and an edge-like diaphragm when a mass ratio of the central dome-like diaphragm and the edge-like diaphragm is 1.5.

FIG. 12 is a graph showing sound pressure versus frequency characteristics obtained from a speaker having an arrangement in which a mass ratio between a central dome-like diaphragm and an edge-like diaphragm is 1.5 and a voice coil bobbin is bonded to a joint flat portion by which the central dome-like diaphragm and the edge-like diaphragm are jointed together. A study of FIG. 12 reveals that audio signal having audio frequencies up to 50 kHz (−10 dB) can be reproduced. At that time, since a balanced dome in which a mass ratio between a central dome-like diaphragm and an edge-like diaphragm is 1:1.5 can be formed, vibrations with highest efficiency can be converted into acoustic output, thereby making it possible to eliminate a dip of sound pressure.

Figure 13:
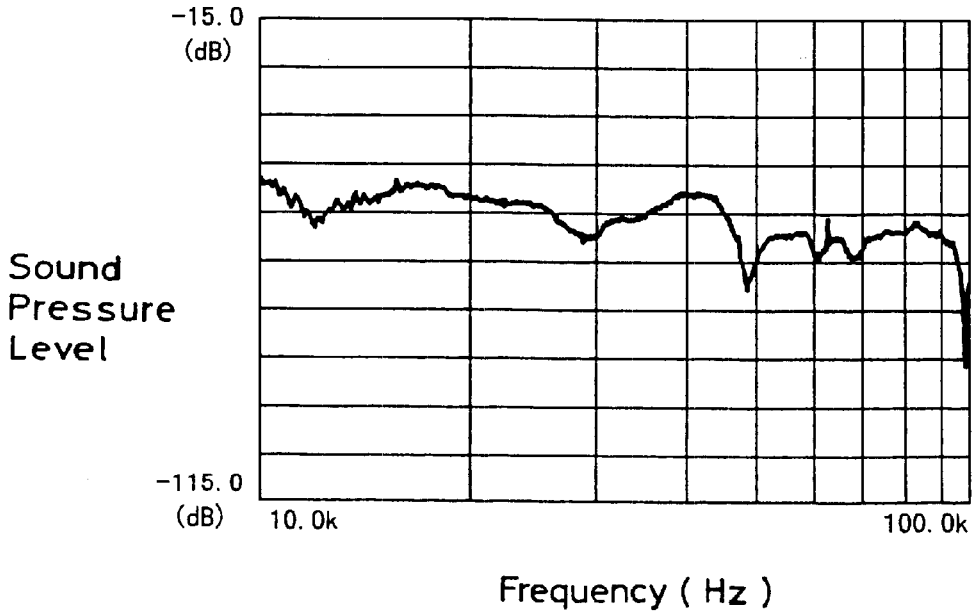
FIG. 13 is a graph showing sound pressure versus frequency characteristics obtained from a speaker having a structure in which a voice coil bobbin is bonded to a joint flat portion between a central dome-like diaphragm and an edge-like diaphragm when a mass ratio of the central dome-like diaphragm and the edge-like diaphragm is 0.4.
Figure 14:
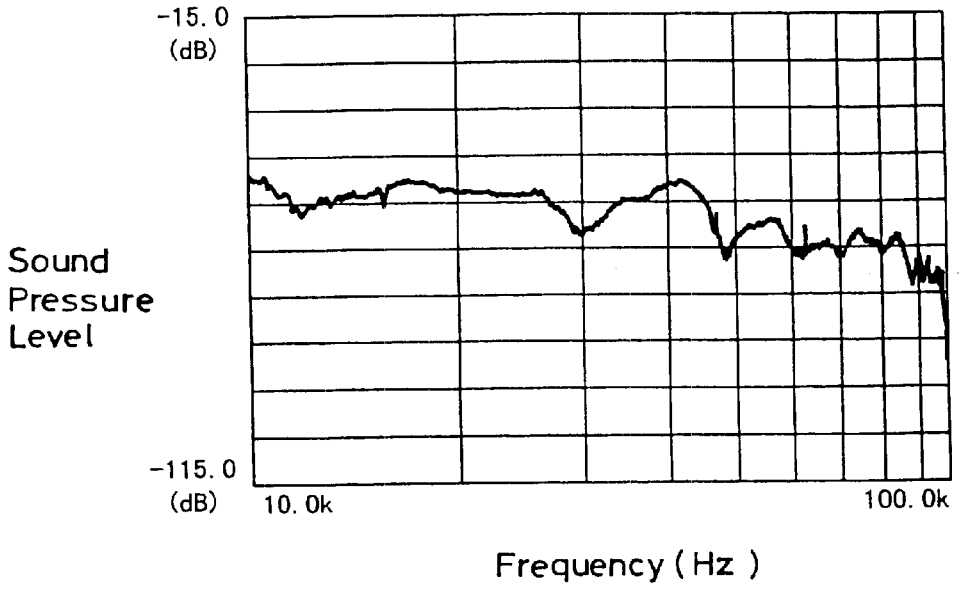
FIG. 14 is a graph showing sound pressure versus frequency characteristics obtained from a speaker having a structure in which a voice coil bobbin is bonded to a joint flat portion between a central dome-like diaphragm and an edge-like diaphragm when a mass ratio of the central dome-like diaphragm and the edge-like diaphragm is 1.6.

FIG. 13 is a graph showing sound pressure versus frequency characteristics obtained from a speaker having an arrangement in which a mass ratio between a central dome-like diaphragm and an edge-like diaphragm is 0.4 and a voice coil bobbin is bonded to a joint flat portion by which the central dome-like diaphragm and the edge-like diaphragm are jointed together. A study of FIG. 13 reveals that audio signal having audio frequencies up to 50 kHz (−10 dB) cannot be reproduced. At that time, since a mass ratio between a central dome-like diaphragm and an edge-like diaphragm becomes 1:0.4 and hence a balanced dome cannot be formed, vibrations with highest efficiency cannot be converted into acoustic output. Accordingly, a dip of a sound pressure cannot be eliminated FIG. 14 is a graph showing sound pressure versus frequency characteristics obtained from a speaker having an arrangement in which a mass ratio between a central dome-like diaphragm and an edge-like diaphragm is 1.6 and a voice coil bobbin is bonded to a joint flat portion by which the central dome-like diaphragm and the edge-like diaphragm are jointed together. A study of FIG. 14 reveals that audio signal having audio frequencies up to 50 kHz (−10 dB) cannot be reproduced. At that time, since a mass ratio between a central dome-like diaphragm and an edge-like diaphragm becomes 1:1.6 and hence a balanced dome cannot be formed, vibrations with highest efficiency cannot be converted into acoustic output. Accordingly, a dip of a sound pressure cannot be eliminated.

Figure 15:
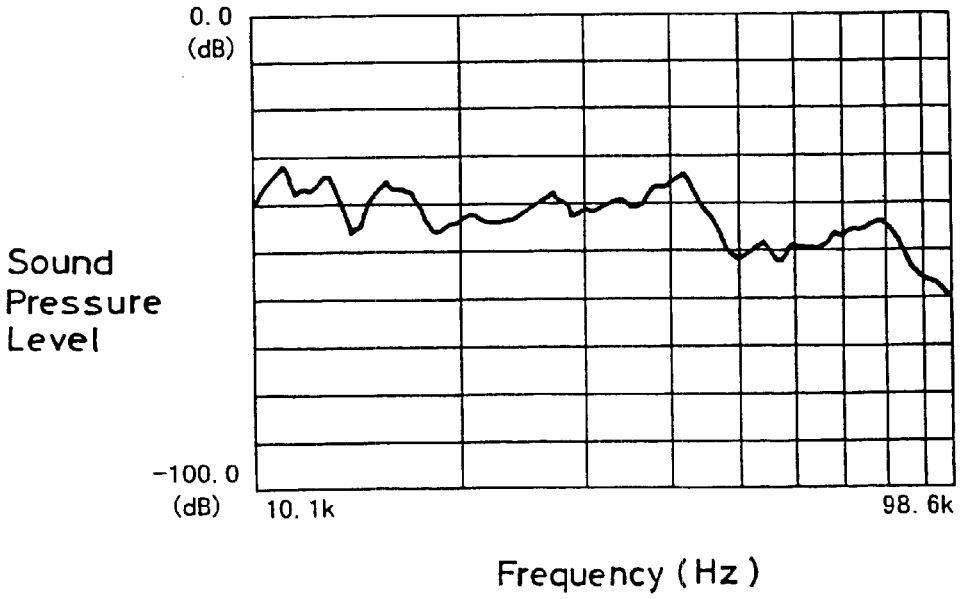
FIG. 15 is a graph showing sound pressure versus frequency characteristics obtained from a speaker having a structure in which a voice coil bobbin is bonded to an inner peripheral edge portion between a central dome-like diaphragm and an edge-like diaphragm when a mass ratio between the central dome-like diaphragm and the edge-like diaphragm is 1.004.

FIG. 15 is a graph showing characteristics obtained when a voice coil bobbin is attached to a speaker apparatus according to the related art, and illustrates sound pressure versus frequency characteristics obtained from a speaker having an arrangement in which a voice coil bobbin is bonded to inner peripheral portions of a central dome-like diaphragm and an edge-like diaphragm when a mass ratio between the central dome-like diaphragm and the edge-like diaphragm is 1.004. As shown in FIG. 15, there occurs a large dip at the frequencies near 15 kHz. At that time, although a balanced dome in which a mass ratio between the central dome-like diaphragm and the edge-like diaphragm is 1:1 can be formed so that audio signals having audio frequencies up to 50 kHz can be reproduced, a strength of the joint flat portion which joints the central dome-like diaphragm and the edge-like diaphragm is small so that a large dip occurs at the frequencies near 15 kHz.

While the joint flat portion for joining the dome-like diaphragm and the edge-like diaphragm and the end face of the voice coil bobbin or the conductive one turn ring are fixed to each other by using the adhesive agent as described above, the present invention is not limited thereto and the joint flat portion and the end face of the voice coil bobbin or the conductive one turn ring may be fixed to each other by using ultrasonic welding.

Furthermore, while the joint flat portion for joining the dome-like diaphragm and the edge-like diaphragm is formed as described above, the present invention is not limited thereto and the flat portion may be formed as small as possible and thereby formed as approximately V-like portion.

Having described a preferred embodiment of the invention with reference to the accompanying drawings, it is to be understood that the invention is not limited to that precise embodiment and that various changes and modifications could be effected therein by one skilled in the art without departing from the spirit or scope of the invention as defined in the appended claims.

What is claimed is:

1. A conductive type speaker apparatus wherein a speaker diaphragm is actuated to vibrate using a voice coil mounted on a bobbin, the speaker apparatus comprising:

a dome-like diaphragm portion joined to an edge-like diaphragm to form the speaker diaphragm, wherein a ratio of a mass of said edge-like diaphragm relative to a mass of said dome-like diaphragm falls within a predetermined range of about 1; and a joint flat portion joining said dome-like diaphragm portion and said edge-like diaphragm portion, wherein an end face of said bobbin is fixedly bonded to said joint flat portion, thereby attaching said bobbin to said speaker diaphragm.

2. The speaker apparatus according to claim 1, wherein said predetermined range of said mass ratio falls within a range from 0.5 to 1.5.

3. The speaker apparatus according to claim 1, wherein said joint flat portion joining said dome-like diaphragm and said edge-like diaphragm has a width substantially equal to a thickness of a material forming said bobbin at said end face of said bobbin whereat said bobbin is bonded to said joint flat portion.

4. The speaker apparatus according to claim 1, wherein a width of said joint flat portion joining said dome-like diaphragm and said edge-like diaphragm is larger than a thickness of a material forming said bobbin at said end face of said bobbin whereat said bobbin is bonded to said joint flat portion of and an adhesive agent coat width formed on said joint flat portion is selected to be substantially equal to the width of said joint flat portion.

5. A conductive electromagnetic induction speaker apparatus wherein a speaker diaphragm is vibrated by electromagnetic induction generated from a conductive one turn ring, comprising:

a dome-like diaphragm portion joined to an edge-like diaphragm portion to form the speaker diaphragm, wherein a ratio of a mass of said edge-like diaphragm relative to a mass of said dome-like diaphragm falls within a predetermined range of about 1; and a joint flat portion joining said dome-like diaphragm portion and said edge-like diaphragm portion, wherein an end face of said conductive one turn ring is fixedly bonded to said joint flat portion, thereby joining said conductive one turn ring to said speaker diaphragm.

6. The speaker apparatus according to claim 5, wherein said predetermined range of said mass ratio falls within a range from 0.5 to 1.5.

7. The speaker apparatus according to claim 5, wherein said joint flat portion joining said dome-like diaphragm and said edge-like diaphragm has a width substantially equal to a thickness of a material forming said conductive one turn ring at said end face of said conductive one turn ring whereat said conductive one turn ring is bonded to said joint flat portion.

8. The speaker apparatus according to claim 5, wherein a width of said joint flat portion joining said dome-like diaphragm and said edge-like diaphragm is larger than a thickness of a material forming said conductive one turn ring at said end face of said conductive one turn ring whereat said conductive one turn ring is bonded to said joint flat portion, and an adhesive agent coat width on said joint flat portion is selected to be substantially equal to the width of said joint flat portion.

* * * * *